United States Patent [19]

Barreau

[11] Patent Number: 4,720,880

[45] Date of Patent: Jan. 26, 1988

[54] PROTECTIVE LINING FOR TOILETS PROVIDED WITH SEATS

[76] Inventor: Jean-Paul Barreau, 16 rue de Livet, 49300 Cholet, France

[21] Appl. No.: 802,169

[22] Filed: Nov. 25, 1985

[30] Foreign Application Priority Data

Jan. 22, 1985 [FR] France ..... 85 01103

[51] Int. Cl.[4] ..... A47K 17/00; A61G 9/00

[52] U.S. Cl. ..... 4/661; 4/300.3; 4/452; 4/222; 4/484; 383/907

[58] Field of Search ..... 4/452, 661, DIG. 18, 4/416, 144.1–144.4, 222, 484, 457; 383/907, 7

[56] References Cited

U.S. PATENT DOCUMENTS

| | | | |
|---|---|---|---|
| 1,987,020 | 1/1935 | Looft | 4/DIG. 18 |
| 2,279,327 | 4/1942 | Kehr | 383/907 |
| 2,688,914 | 9/1954 | Eckler | 383/907 |
| 2,801,426 | 8/1957 | La Gorce et al. | 4/484 |
| 2,817,851 | 12/1957 | Barnwell | 4/DIG. 18 |
| 3,115,644 | 12/1963 | Bloodworth | 4/452 |
| 3,176,317 | 4/1965 | Kelseaux | 4/452 X |
| 3,381,315 | 5/1968 | Glassberg | 4/144.2 X |
| 3,475,767 | 11/1969 | Friesen et al. | 4/452 |
| 3,495,278 | 2/1970 | Peters | 4/144.2 X |
| 3,546,716 | 12/1970 | Laumann | 4/452 |
| 3,605,127 | 9/1971 | Dailey | 4/452 |
| 3,654,638 | 4/1972 | Nye | 4/144.1 |
| 3,763,502 | 10/1973 | Lauman | 4/452 |
| 4,011,606 | 3/1977 | Scrafield et al. | 4/457 |
| 4,305,161 | 12/1981 | Diaz | 383/7 |
| 4,567,613 | 2/1986 | Meehan | 4/222 |

FOREIGN PATENT DOCUMENTS

| | | | |
|---|---|---|---|
| 2048316 | 4/1972 | Fed. Rep. of Germany | 4/DIG. 18 |
| 2202400 | 1/1973 | Fed. Rep. of Germany | 4/DIG. 18 |
| 2240957 | 2/1974 | Fed. Rep. of Germany . | |
| 2326497 | 12/1974 | Fed. Rep. of Germany | 4/DIG. 18 |
| 3212243 | 10/1983 | Fed. Rep. of Germany . | |
| 3216136 | 11/1983 | Fed. Rep. of Germany . | |
| 2435241 | 4/1980 | France . | |
| 2539985 | 8/1984 | France . | |
| 1339675 | 12/1973 | United Kingdom . | |
| 1387994 | 3/1975 | United Kingdom . | |

OTHER PUBLICATIONS

Device for the Separate Collection of Human Urine and Feces by B. Isaksson, Nov. 14, 1961, Scandinav. J. Clin. & Lab. Investigation 418, 14, 1962; p. 418.

*Primary Examiner*—Henry K. Artis
*Attorney, Agent, or Firm*—Sandler & Greenblum

[57] ABSTRACT

A protective lining assembly made of biodegradable material of the paper type and intended to be used in toilets provided with seats. The lining comprises a flange intended to engage the seat, and bag located into the basin and integral with the flange. The assembly forms an isolating protective shield between the user and the toilet.

22 Claims, 6 Drawing Figures

PROTECTIVE LINING FOR TOILETS PROVIDED WITH SEATS

BACKGROUND OF THE INVENTION

1. Field of the Invention

The present invention relates to a disposable protective lining which is usable particularly for toilets provided with seats and more particularly in public toilets.

2. Technological Background

Many devices, which are very complex and expensive, have been proposed with the purpose of obviating the difficulty of keeping the toilets clean and keeping them tidy. As described, for example in French Pat. No. FR-A-2,435,241, it has been proposed a lining made of disposable paper, of the tissue type. The lining was pre-cut and was disposed in a cartridge, so as to form a reserve near the basin. After use, this biodegradable lining is preferably introduced into the basin and is released from the basin and disposed of by means of flushing water.

However this device only brought a partial solution which did not satisfy all the users, due to possible strong psychological barriers.

A more suitable protective lining has been proposed, such as that described in Great Britain Pat. No. 1,339,675. This lining is furnished with a flange connected to a lining having a hemispherical shape which is placed in the basin. This type of fitting is difficult to effect because the shape is not expandable and because of the presence of pockets necessary for emptying the lining.

The aim of the present invention is to provide a protective lining which eliminates this drawbacks, while enabling a complete comfort to be provided in said public toilets.

SUMMARY OF THE INVENTION

The liner according to the present invention is simpler and is constituted by elements which are easy to make and which can be made by very low cost production techniques.

One object of the invention is to provide a lining that adapts very easily to any type of basin and can be quickly emptied.

The invention also offers the advantage of being a product the availability of which is greatly facilitated by its original presentation and the packaging of which permits anyone to carry one with them in case of temporary or permanent absence of a supply in the restroom.

One object of the invention is to provide a protective lining which is more attractive than the previous ones and which has a high hygienic rate so as to be effective in all of the cases, even the more unfavorable ones.

Another object of the invention is to provide lining which substantially operates as a real shield and enables the user to be fully isolated from the toilet seats.

A further object of the invention is to enable the manual cleanings, more particularly with respect to the basin, to be reduced to a large extent and perhaps to be eliminated.

The invention has another advantage of providing a product which is disposable and remarkable with respect to the original appearance and packaging thereof that enables anybody to obviate a momentary or permanent absence of linings in any toilet to be used.

According to the present invention, the protective lining is essentially constituted by elements which form substantially planar walls of which at least two are glued or connected together at the bottom of the bag.

According to the invention, the protective lining is made of a material of the biodegradable type, which is compatible with the conventional paths for disposing of the fecal matter. The lining consists of a device comprising a flange and a bag. The flange bears on the seat, whereas the bag is located within the basin and substantially matches the shape thereof. The assembly comprising the flange and the bag is so designed as to fully isolate the user from the relative toilet.

According to a first embodiment of the present invention, the lining bag matches the shape of the basin and comprises a rear wall which is substantially vertical, two lateral walls and a front wall which is inclined between the front portion of the flange and the bottom of the bag.

According to a second embodiment, which enables the manufacture of the lining to be improved and the automatization of the manufacture to be facilitated so as to provide large scale production, the lining is generally shaped as a boat, which is obtained by the assembly of the paper sheets, consisting of a substantially trapezoidal portion forming the bag and of a longitudinally elongated portion at the upper portion of the bag, which forms the flange.

According to a preferred embodiment of the invention, the lining comprises two identical sheets the little base and the relative oblique sides of which are assembled by an adhesive procedure.

According to a further embodiment of the invention, the front portion of the lining bag comprises a broad adhesive strap formed by substantially overlying the two sheets so as to form a reinforcement able to protect, inter alia, when during a strong or large urination.

According to a further preferred embodiment of the invention, in order to also improve the strength of the lining, the bag comprises an internal transverse partition provided for parting the urine from the defecation.

According to the invention, the lining may comprises fixing means of the adhesive type and laterally located tabs which are intended to facilitate the unfolding and the fixing of the lining onto the seat. The flange may, to this end, comprise adhesive means intended to attach it on to the respective seat. This adhesive means may be operated by unfolding the tabs.

According to a further feature of the invention, the lining flange comprises a few sheets of biodegradable materials, which are adhered to each other and comprise at least one sheet of impermeable biodegradable paper.

According to a further embodiment of the invention, the lining comprises, at the external lower portion of the bag, a coating means comprising at least one product which would be rendered active at the contact with the water, and more particularly with the flushing water from the water tank. This product may be diluted among the perfume, the disinfecting materials, the scaling materials or a mixture of them. In addition, the bag may comprise a coating means which is rendered active upon contact of water, which may comprise a product of the bacterial type which is not detrimental for the user and is intended to accelerate the destructive process of the bag after the bag is released.

According to a further embodiment of the invention, the lining is available as a foldable device, comprising a plurality of bellows which enable said lining to be easily adapted to the different types of basins.

According to another preferred embodiment of the invention, the protective lining is available as a folded device which is packed into a small pouch which can be easily handled by the user.

This packaging pouch may advantageously be made of a biodegradable material and comprise tissue paper.

BRIEF DESCRIPTION OF THE DRAWINGS

The present invention will more fully appear from the following description made in connection with the accompanying drawings wherein.

DETAILED DESCRIPTION OF THE PREFERRED EMBODIMENTS

Figure 1:
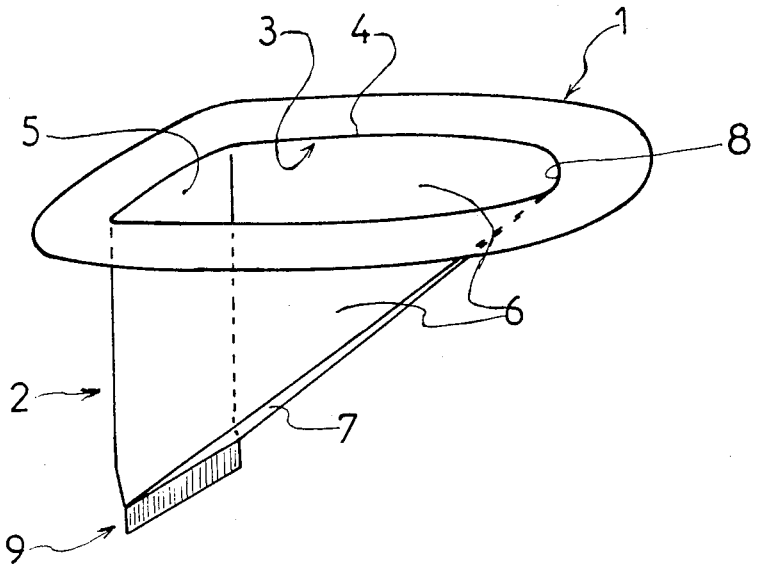
FIG. 1 shows a protective lining according to a first embodiment of the invention.

The protective lining according to FIG. 1 consists of a flange 1 which is intended to be mounted on a conventional toilet seat.

Preferably flange 1 slightly projects out of the seat and substantially covers it as to ensure good protection.

A bag 2 is integral with the flange 1 as to form with the latter an overall lining which covers without any interruption the seat and the basin, not shown in the drawings.

The edge of the upper portion 3 of the bag 2 is integral with the internal edge 4 of flange 1, this connection being made by any suitable means, for instance by an adhesive means or the like. The shape of the bag 2 is adapted to the shape of the conventional basins for toilets. It comprises a rear wall 5 which is substantially vertical, two lateral walls 6 which are also vertical and a front wall 7 which is inclined between the front portion 8 of flange 1 and the lower portion 9 of bag 2. This inclined wall particularly enables the urine flows to be guided so as to allow the stains at the upper and the front portions of the basin to be eliminated.

The lower portion 9 of bag 2 is preferably closed by an adhesive means for instance as to avoid the water projection or spraying resulting from the defecation fall. Accordingly bag 2 generally avoids the stains in the basin, due to the defecation. The latter, as well as urines, remain contained in the bag, without any contact with the basin or with the water reserve contained in the basin.

Figure 2:
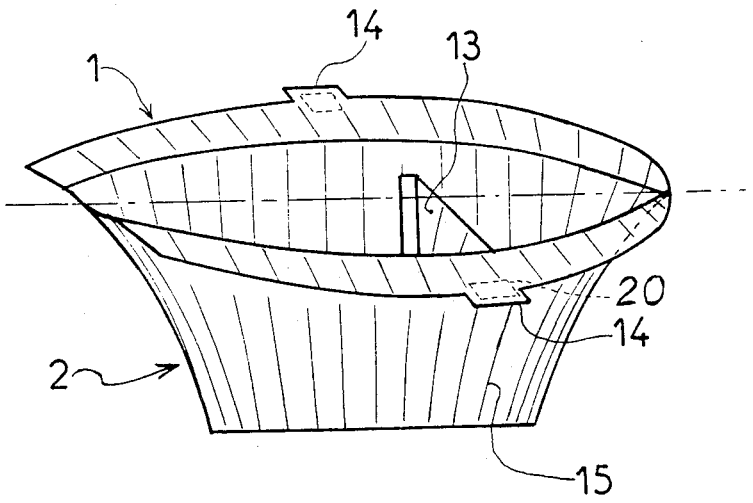
FIG. 2 shows a protective lining according to a second embodiment of the invention.
Figure 3:
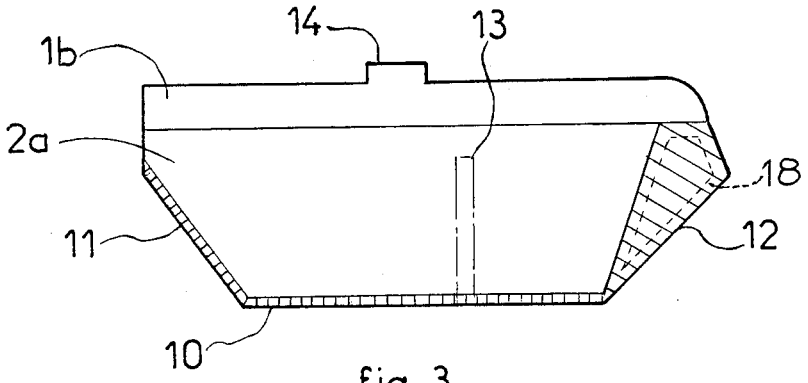
FIG. 3 shows a paper sheet used for making a protective lining according to the second embodiment.
Figure 4:
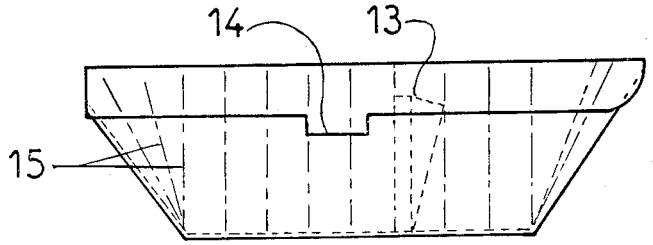
FIG. 4 shows an assembled prefolded lining according to the second embodiment.

The protective lining shown in FIGS. 2 to 4 has a shape which is akin, when it is in its unfolded state, to the shape of a boat and more particularly to the boat hull.

The lining comprises a flange 1 intended to cover the seat, not shown in the drawing, and a bag which is located in the basin, not shown at the drawing. The two sides of flange 1 end together at the front portion thereof and is slightly opened at the rear portion thereof.

The lining is obtained from two identical paper sheets which are shown in FIG. 3. The paper sheet comprises a portion 2*a* having a substantially trapezoidal shape constituting one side of bag 2 and, at the top portion of the bag, a portion 1*b* which extends longitudinally as to form a half portion of the flange 1 on each sheet. The small base 10 and the oblique sides 11 and 12 of the trapezoidal portion 2*a* are intended to be assembled by overlying portions thereof and connecting them by means of an adhesive strip 18 or the like. The assembling part of the front portion of the lining, that is to say at the level of the oblique side 12, may be substantially stronger than that of the other sides, as shown in hatched portions on FIG . 3, so as to form a reinforcement. In fact the assembly by means of overlying procedure enables a double sheet of paper to be provided that will provide better withstanding inter alia, of a large or strong urination.

Another reinforcement of the lining particularly appears on FIG. 2. This reinforcement comprises an internal partition 13 integral with the bag and intended to separate the urine from the defecation.

The position of this internal partition 13 appears on the sheet shown in FIG. 3 and on the assembled flat lining in FIG. 4.

This partition 13 is located in the front half portion of the bag.

As shown in FIGS. 2 to 4, the lining also includes tabs 14 which are laterally located and integral with flange 1. These tabs are intended to facilitate unfolding the lining and mounting it on the seat. Means may also be provided for fixing the flange 1 on the seat. This means particularly may comprise adhesives 20 which are shown in FIG. 2 and are located under flange 1. The bag is more easily unfolded by means of tabs 14.

Normally the lining has a folded shape which is easily adapted to be displayed, packaged and dispensed.

FIG. 4 shows the boat-shaped lining, as assembled, the flange 1 being folded on bag 2. Folding lines 15 which are vertical at the center of the bag and oblique on the sides appear in small dotted lines. The folding has the advantage of both reducing the bulking of the lining to a mere parallelopipedal-shaped block and forming a plurality of bellows 22 which enables the lining to be adapted to different shapes, features and sizes of the basins offered to a user.

As a general concept, flange 1 may be reinforced and consist of a plurality of sheets of papers having different natures, which may be adhered or welded on each other. Provision may be possibly made for covering flange 1 by means of an impermeable biodegradable material which is intended to be in direct contact with the seat.

Additionally, bag 2 comprises, from the lower portion up to about mid-height thereof, an impregnation or coating of products, such as perfumes, desinfecting and scaling materials or mixtures thereof. This impregnations became active upon contact with water. They are in contact with the flushing water reserve of the basin as soon as the user lifts the seat. The weight of the defecation and/or of urine drives the lining towards the basin bottom. The flushing water accelerates the activation of the comfort and cleaning products before the lining and its content is released. Similarly, in order to accelerate the destruction of the bag after it is released, provision may be made on the bag for a coating of a product of the bacterial type which is not detrimental for the user and is rendered active by means of the flushing water during the releasing of the defecation.

Figure 5:
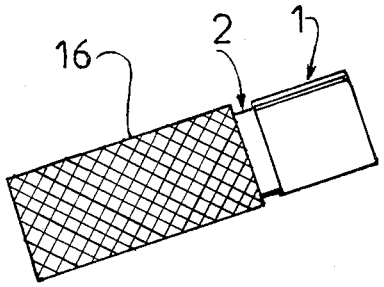
FIG. 5 shows a protective lining which is folded and packaged in a pouch consisting of a small roll of tissue paper.
Figure 5A:
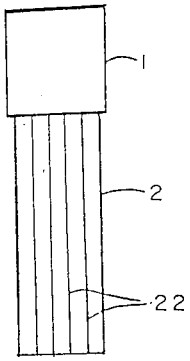
FIG. 5*a* shows a protective lining which is folded into bellows.

As shown in FIG. 5, the lining is folded and located into a disposable packaging having the shape of a roll 16 consisting of a few tissue paper sheets. A portion of bag 2 is introduced within roll 16. Projecting portion which appears on FIG. 5 particularly consists of flange 1.

Provision may be made for a different packaging by merely locating the folding lining within a suitable packaging together with a few tissue paper sheets, the packaging itself being made of a biodegradable material.

What I claim is:

1. A protective lining for toilets, said toilets having a toilet seat, said lining made of biodegradable material and comprising:

(a) a flange adapted to be positioned on said toilet seat; and (b) a bag integral with said flange, said bag being substantially water-tight and adapted to be placed in said basin, said bag comprising at least two substantially planar walls fixedly attached to one another at one end to form a bag bottom;

wherein said bag comprises an internal transverse partition for separating urine from defecation, said partition being located in a front half of said bag;

wherein said lining comprises means for folding said lining along a plurality of fold lines, said means for folding comprising bellows for fitting said lining into basins having a variety of shapes and sizes.

2. The protective lining as set forth in claim 14, wherein said bag is adapted to substantially conform to the shape of said basin and said at least two substantially planar walls extend between the bottom of said bag and said flange, said at least two walls comprising a substantially vertical rear wall, two side walls and a front wall which is inclined between a front portion of said flange and a bottom portion of said bag.

3. The protective lining as set forth in claim 14, wherein said lining has a generally boat shaped configuration and is formed by assembling sheets, said sheets comprising a substantially trapezoidal portion forming the bag and a longitudinally elongated portion projecting from an upper portion of the bag for forming the flange.

4. The protective lining as set forth in claim 3, wherein said sheets comprise two substantially identical sheets, wherein the trapezoidal portions of said two substantially identical sheets each have a small base member and two oblique side members, said members of each respective substantially identical sheet being assembled with each other, respectively.

5. The protective lining as set forth in claim 4, wherein a front portion of said bag comprises a broad adhesive strip member formed by overlying a large portion of one of said two substantially identical sheets over the other of said two substantially identical sheets so as to provide reinforcement for withstanding strong urinations.

6. The protective lining as set forth in claim 1, wherein said flange comprises laterally placed tabs integral with said flange for unfolding said lining and for affixing said lining to the seat.

7. The protective lining as set forth in claim 1, wherein said flange comprises a plurality of sheets made of biodegradable material adhered to each other, at least one of said sheets being made of an impermeable biodegradable paper.

8. The protective lining as set forth in claim 1, wherein a lower portion of said bag comprises a coating of at least one product selected from among various perfumes, disinfectants, scaling materials and mixtures thereof.

9. The protective lining as set forth in claim 14, wherein said bag comprises a coating which becomes active upon contact with water, said coating comprising at least one product of a bacterial type for accelerating destruction of said bag after said bag is released from the basin.

10. The protective lining as set forth in claim 1, wherein said lining has the shape of a parallelopipedal block obtained by folding a sheet and having a plurality of bellows in said folded sheet.

11. The protective lining as set forth in claim 10, wherein said lining has the shape of a pouch and comprises a small roll of tissue paper.

12. The protective lining as set forth in claim 6, wherein said flange comprises adhesive means for holding said flange against the seat and operated by means of tabs.

13. A protective lining for toilets, said toilets having a toilet seat and a basin, said lining comprising:

(a) a flange adapted to be positioned on said toilet seat; and (b) a bag adapted to be placed in said basin covering all sides of the interior of said basin, said bag comprising at least two substantially planar walls each having an upper portion and a lower portion, said upper portion of said at least two walls being integrally connected to said flange and said lower portion of said at least two walls being fixedly attached to one another so as to form a bag bottom;

wherein said lining comprises means for folding said lining along a plurality of fold lines, said means for folding comprising bellows for fitting said lining into basins for having a variety of shapes and sizes;

wherein said bag comprises an internal transverse partition for separating urine from defecation, said partition being located in a front half of said bag.

14. The protective lining as set forth in claim 13 wherein said at least two substantially planar walls comprise:

(a) a substantially vertical rear wall for covering a rear portion of said basin, (b) two side walls for covering two side portions of said basin, each side wall having one edge connected to said rear wall; and (c) a front wall for covering a front portion of said basin, said front wall having two edges connected to said side walls, respectively, and said front wall being inclined between said flange and said bag bottom.

15. The protective lining as set forth in claim 13 wherein said at least two substantially planar walls comprise two sheets of a material having a substantially similar shape, said two sheets each comprising a substantially trapezoidal bottom portion and a longitudinally elongated upper portion integral with an upper edge of said trapezoidal portion forming said flange.

16. The protective lining as set forth in claim 15 wherein said trapezoidal portion of each sheet comprising a base, which is narrower than said upper edge, and two outwardly inclined side edges, wherein said two side edges and said base of one of said two sheets are connected to said two side edges and said base of the other of said two sheets forming said bag.

17. The protective lining as set forth in claim 13 wherein said flange comprises at least two tabs extending from an outside edge thereof for facilitating opening of said bag.

18. The protective lining as set forth in claim 13 wherein said bag is water-tight and comprises a transverse partition extending from one side of said bag to another side of said bag for separating said bag into two sectors.

19. The protective lining as set forth in claim 13 wherein said flange comprises a plurality of layers made of biodegradable material, said plurality of layers being connected together and at least one of said plurality of layers being formed from an impermeable biodegradable paper.

20. The protective lining as set forth in claim 13 wherein said flange comprises an adhesive for attaching said flange to said seat.

21. The protective lining as set forth in claim 13 wherein a lower portion of said bag comprises a chemical coating which is rendered active upon contact with water.

22. A protective lining for toilets, said toilets having a toilet seat and a basin, said lining comprising:

(a) a flange adapted to be positioned on said toilet seat, said flange comprising a plurality of tabs extending from an outside edge thereof for facilitating opening of said bag; and (b) a bag adapted to be placed in said basin covering all sides of the interior of said basin, said bag comprising at least two substantially planar walls each having an upper portion and a lower portion, said upper portion of said at least two walls being integrally connected to said flange and said lower portion of said at least two walls being fixedly attached to one another so as to form a bag bottom;

wherein said lining comprises means for folding said lining along a plurality of fold lines, said means for folding comprising bellows for fitting said lining into basins having a variety of shapes and sizes.

* * * * *

UNITED STATES PATENT AND TRADEMARK OFFICE

CERTIFICATE OF CORRECTION

PATENT NO. : 4,720,880

DATED : January 26, 1988

INVENTOR(S) : Jean-Paul BARREAU

It is certified that error appears in the above-identified patent and that said Letters Patent is hereby corrected as shown below:

At column 1, line 35, change "this" to ---these---.

At column 1, line 36, delete "a".

At column 1, line 57, insert ---a--- before "lining".

At column 2, line 37, change "when" to ---even---.

At column 2, line 42, change "comprises" to ---comprise---.

At column 3, line 11, change "will more fully appear" to ---will be more clear---.

At column 4, line 38, insert ---This objective is achieved by a number of folding lines 15 provided on the lining.--- after "dispensed".

At column 5, lines 31 and 39, change "14" to ---1---. At column 6, line 6, change "14" to ---1---.

At column 6, lines 63 and 64, change "comprising" to ---comprises---.

Signed and Sealed this

Eighteenth Day of October, 1988

*Attest:*

*Attesting Officer*

DONALD J. QUIGG

*Commissioner of Patents and Trademarks*